US006655109B2

(12) United States Patent
Resterhouse et al.

(10) Patent No.: US 6,655,109 B2
(45) Date of Patent: Dec. 2, 2003

(54) FILLER DEVICE SUB-ASSEMBLY AND ASSOCIATED METHOD

(75) Inventors: Michael R. Resterhouse, Muskegon, MI (US); Simon P. Edwards, Irvine, CA (US); Robert B. Szabo, II, Allegan, MI (US)

(73) Assignees: Fogg Filler Company, Holland, MI (US); Scholle Corporation, Irvine, CA (US)

( * ) Notice: Subject to any disclaimer, the term of this patent is extended or adjusted under 35 U.S.C. 154(b) by 61 days.

(21) Appl. No.: 09/871,562

(22) Filed: May 31, 2001

(65) Prior Publication Data

US 2002/0017075 A1 Feb. 14, 2002

Related U.S. Application Data

(60) Provisional application No. 60/208,185, filed on May 31, 2000.

(51) Int. Cl.[7] ..... B65B 3/00

(52) U.S. Cl. ..... 53/281; 53/266.1; 53/268; 53/300; 53/287

(58) Field of Search ..... 53/281, 284.5, 53/300, 306, 308, 310, 312, 365, 287, 346, 347, 355, 356, 357, 367

(56) References Cited

U.S. PATENT DOCUMENTS

| | | | | | |
|---|---|---|---|---|---|
| 4,378,665 | A | * | 4/1983 | Crankshaw et al. | 53/276 |
| 4,498,508 | A | * | 2/1985 | Scholle et al. | 53/109 |
| 4,765,119 | A | * | 8/1988 | Aidlin et al. | 53/308 |
| 5,402,623 | A | * | 4/1995 | Ahlers | 53/268 |
| 5,711,411 | A | * | 1/1998 | Zurweller | 198/379 |
| 5,844,677 | A | * | 12/1998 | Dimmick et al. | 356/240.1 |
| 6,302,172 | B1 | * | 10/2001 | De Villele | 141/372 |
| 6,399,901 | B1 | * | 6/2002 | Nishino et al. | 141/372 |

* cited by examiner

*Primary Examiner*—Eugene Kim
*Assistant Examiner*—Thanh Truong
(74) *Attorney, Agent, or Firm*—King & Jovanovic, PLC

(57) ABSTRACT

A filler device sub-assembly comprising: a first cap gripping arm and a second cap gripping arm, wherein each of the first and second cap gripping arms include a second end, and wherein the second ends of the first and second cap gripping arms cooperatively define a cap retaining region; a pivot opening associated with each of the first and second cap gripping arms, wherein the first and second cap gripping arms are pivotable about the pivot opening; and means for guiding a cap into the cap retaining region, wherein the cap guiding means facilitates outward pivoting of at least one of the first and second cap gripping arms by a cap which results in directing a cap into the retaining region toward retention thereof.

10 Claims, 10 Drawing Sheets

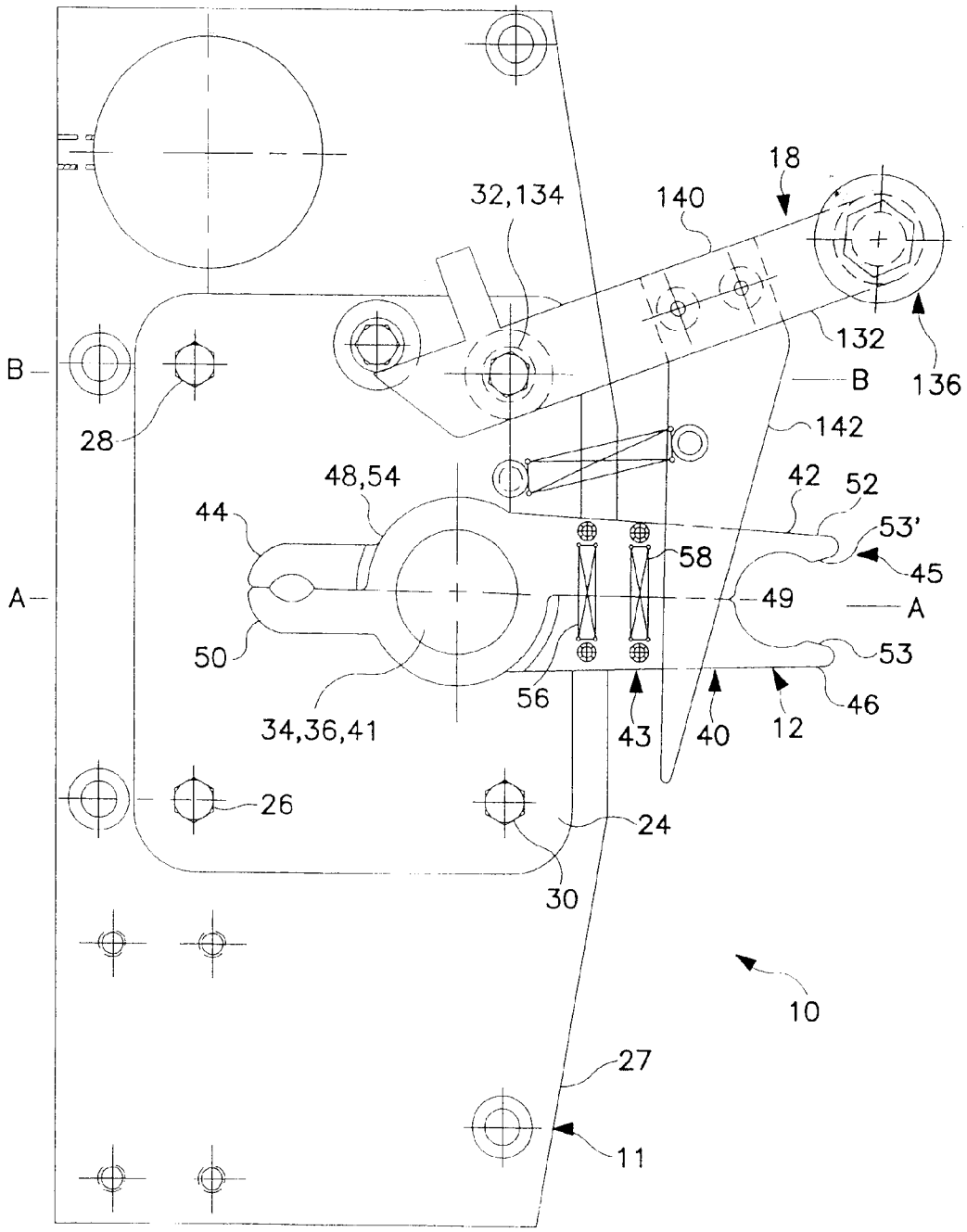
FIG. IB

FILLER DEVICE SUB-ASSEMBLY AND ASSOCIATED METHOD

CROSS REFERENCE TO RELATED APPLICATIONS

This application claims the benefit of U.S. Provisional Application No. 60/208,185 filed May 31, 2000, which is hereby incorporated by reference in its entirety.

BACKGROUND OF THE INVENTION

1. Field of the Invention

The present invention relates in general to a filler device sub-assembly, and more particularly, to a filler device sub-assembly, which among other things, substantially precludes air and/or other matter from undesirably entering an associated container upon and/or prior to filling of the same and/or which facilitates reliable uncapping, capping, and/or recapping of the container.

2. Background Art

Filling assemblies for use in association with filler devices have been known in the art for years and are the subject of numerous patents including: U.S. Pat. No. 5,845,683; U.S. Pat. No. 5,740,844; U.S. Pat. No. 5,690,151; U.S. Pat. No. 5,533,552; U.S. Pat. No. 5,531,253; U.S. Pat. No. 5,450,882; U.S. Pat. No. 5,402,833; U.S. Pat. No. 4,848,381; U.S. Pat. No. 4,437,498; U.S. Pat. No. 4,219,054; U.S. Pat. No. 3,774,658; U.S. Pat. No. 3,568,734; U.S. Pat. No. 3,430,639; EP Pat. No. 568,121 A1; and EP Pat. No. 554,951 A1. While the above-identified fill assemblies have become commercially available for use in association with filler devices, problems associated with precluding air and/or other undesirable matter from entering an associated container before filling as well as uncapping, capping, and/or recapping at an operatively acceptable speed remain largely problematic. In addition, problems associated with replacing a stock or common cap associated with a pre-filled and/or pre-capped container with a different, specialized cap have been identified.

It is therefore an object of the present invention to provide a reliable, filler device sub-assembly for use in association with any one of a number of filler devices, including rotary fillers, which remedies the detriments and/or complications associated with conventional filler assemblies known in the art.

These and other objects of the present invention will become apparent in light of the present specification, claims, and drawings.

SUMMARY OF THE INVENTION

The present invention is directed to a filler device sub-assembly comprising: (a) a first cap gripping arm and a second cap gripping arm, wherein each of the first and second cap gripping arms include a second end, and wherein the second ends of the first and second cap gripping arms cooperatively define a cap retaining region; (b) a pivot opening associated with each of the first and second cap gripping arms, wherein the first and second cap gripping arms are pivotable about the pivot opening; and (c) means for guiding a cap into the cap retaining region, wherein the cap guiding means facilitates outward pivoting of at least one of the first and second cap gripping arms by a cap which results in directing a cap into the retaining region toward retention thereof.

In a preferred embodiment of the present invention, the cap guiding means further includes an extending surface associated with at least one of the first and second cap gripping arms, wherein the extending surface facilitates the outward pivoting of the associated cap gripping arm upon contact by a cap. In this embodiment, each of the first and second cap gripping arms may include an extending surface.

In another preferred embodiment of the present invention, each second end of the first and second cap gripping arms is configured so that the defined retaining region substantially matches the configuration of a cap.

In yet another preferred embodiment of the present invention, the filler device sub-assembly further comprises means for biasing each of the first and second cap gripping arms toward each other. In this embodiment, the biasing means may comprise at least one spring attached to each of the first and second cap gripping arms.

In a preferred embodiment of the present invention, the filler device sub-assembly further includes means for sensing at least one of the presence or absence of a cap within the holding region. In this embodiment, the sensing means may comprise a proximity sensor.

In accordance with the present invention, the filler device sub-assembly may further comprise: (a) a first rim gripping arm and a second rim gripping arm, wherein each of the first and second rim gripping arms include a second end, and wherein the second ends of the first and second rim gripping arms cooperatively define a rim retaining region, and further wherein the first and second rim gripping arms are pivotable about the pivot opening and; (b) means for guiding a rim of a container into the rim retaining region, wherein the rim guiding means facilitates outward pivoting of at least one of the first and second rim gripping arms by a rim of a container which results in directing the rim of a container into the rim retaining region toward retention thereof.

The present invention is also directed to a filler device sub-assembly comprising: (a) a first rim gripping arm and a second rim gripping arm, wherein each of the first and second rim gripping arms include a second end, and wherein the second ends of the first and second rim gripping arms cooperatively define a rim retaining region; (b) a pivot opening associated with each of the first and second rim gripping arms, wherein the first and second rim gripping arms are pivotable about the pivot opening; and (c) means for guiding a rim of a container into the rim retaining region, wherein the rim guiding means facilitates outward pivoting of at least one of the first and second rim gripping arms by a rim of a container which results in directing the rim of a container into the retaining region toward retention thereof.

In another aspect of the invention, the invention comprises a filler device sub-assembly for filling a container with product. The container includes an inner surface, an inner volume, a rim and a cap. The sub-assembly comprises means for retaining a rim of a container, means for substantially sealing rim and means for manipulating the cap. The substantial sealing means substantially seals at least one of the product and a portion of the inner surface of the container against a rim of the container, to, in turn, substantially preclude the ingress to and egress from the volume of the container. The manipulating means manipulates the cap of the container, to in turn, remove the cap from the rim of the container, and, to re-engage the cap onto the rim of the container. The removal and re-engagement of the cap occurs when the substantial sealing means actively substantially seals the volume of the container.

The present invention is also directed to a filler device sub-assembly having a means for manipulating a cap. The cap manipulating means includes a rotation post, first and second cap gripper arms and a cam. The rotation post includes a follower attached thereto. The first and second cap gripper arms are capable of retaining the cap in a gripped orientation. The first and second cap gripper arms are pivotally associated with the rotation post. The cam is associated with the follower such that the cam actuates the follower to, in turn, impart rotation of the rotation post and associated cap gripper arms a predetermined arcuate distance upon movement of the rotation post in either of a substantially upward and substantially downward movement.

In another aspect of the invention, the cam may include an upper cam portion and a lower cam portion. The cam actuates the follower. In turn, the cam through the follower imparts rotation of the rotation post and associated cap gripper arms a predetermined arcuate distance upon movement of the rotation post in one of substantially upward and substantially downward movement. Subsequently, the cam imparts rotation of the rotation post a further predetermined arcuate distance in the same direction upon movement of the rotation post in the other of the substantially upward and substantially downward movement. As a result, continued upward and downward movement directs the rotation post through a full circular rotation.

BRIEF DESCRIPTION OF THE DRAWINGS

The invention will now be described with reference to the drawings wherein:

FIG. 1B of the drawings is a fragmentary top view of a filler device sub-assembly in accordance with the present invention showing, in particular, the rim retaining means;

DETAILED DESCRIPTION OF THE INVENTION

Figure 1A:
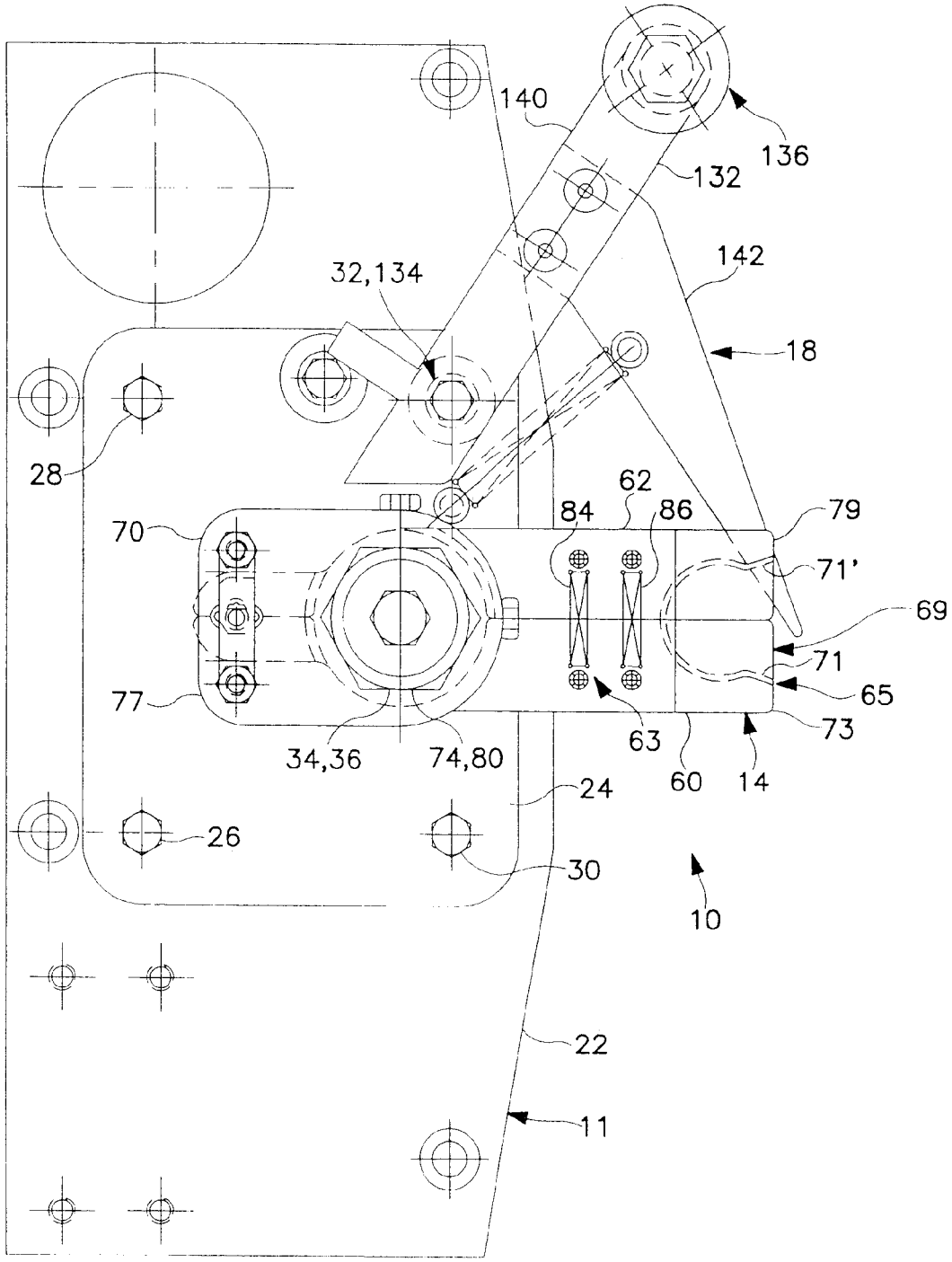
FIG. 1A of the drawings is a fragmentary top view of a filler device sub-assembly in accordance with the present invention showing, in particular, the cap manipulating means.

While this invention is susceptible of embodiment in many different forms, there is shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, are identified throughout the drawings by like reference characters.

Referring now to the drawings and collectively to FIGS. 1A–4 in particular, schematic representations of a filler device sub-assembly 10 are shown, which generally comprises housing 11, means 12 for retaining a rim of a container, means 14 for manipulating a cap of a container, means 16 for substantially sealing a portion of a container against a rim of a container, means 18 for ejecting a rim of a container, and means 19 for sensing the presence or absence of at least one of a cap or a rim of a container. It will be understood that FIGS. 1–9 are merely schematic representations of a filler device sub-assembly. As such, some of the components have been distorted from their actual scale for pictorial clarity.

Figure 8:
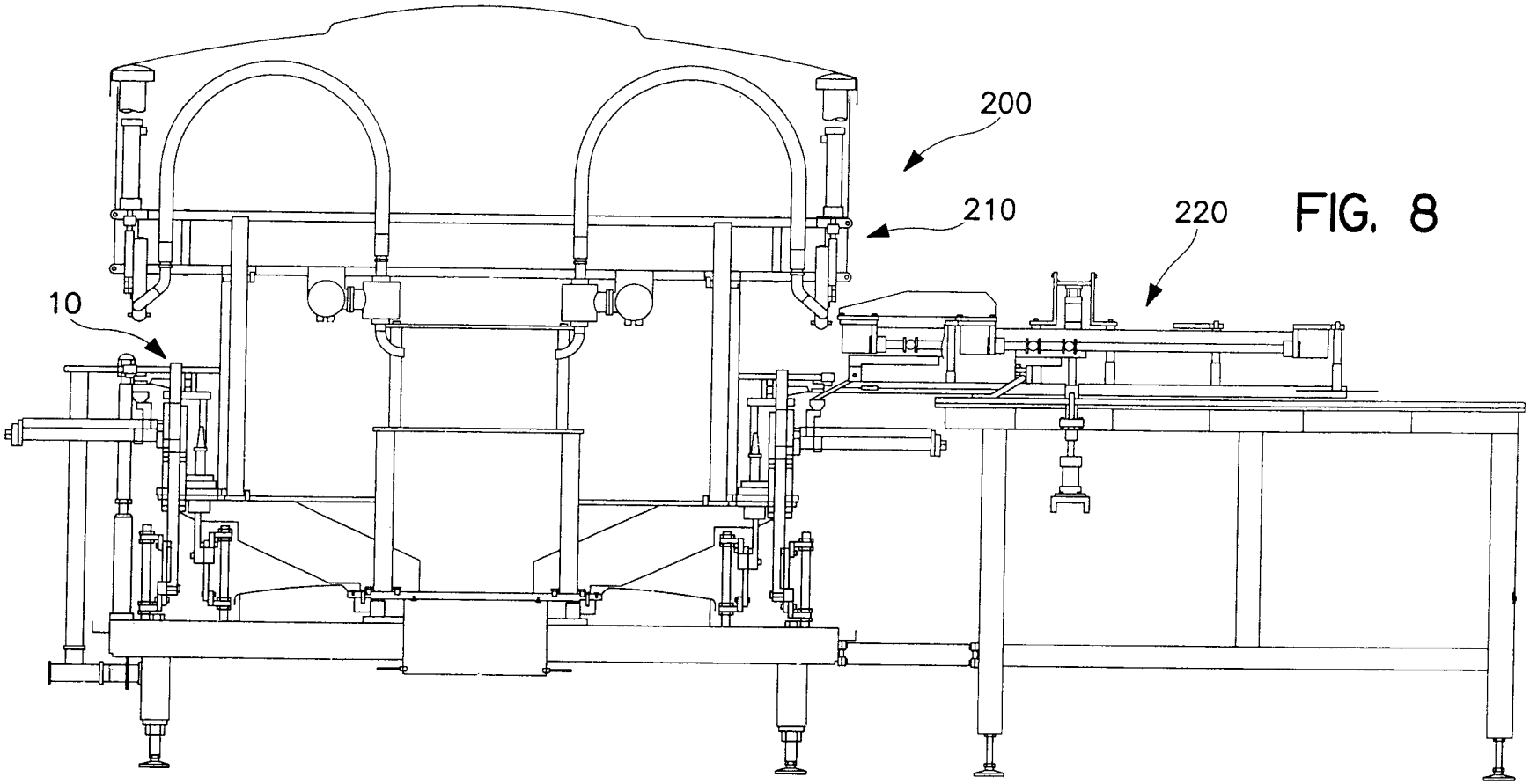
FIG. 8 of the drawings is a side elevational view of a filler device in accordance with the present invention.
Figure 9:
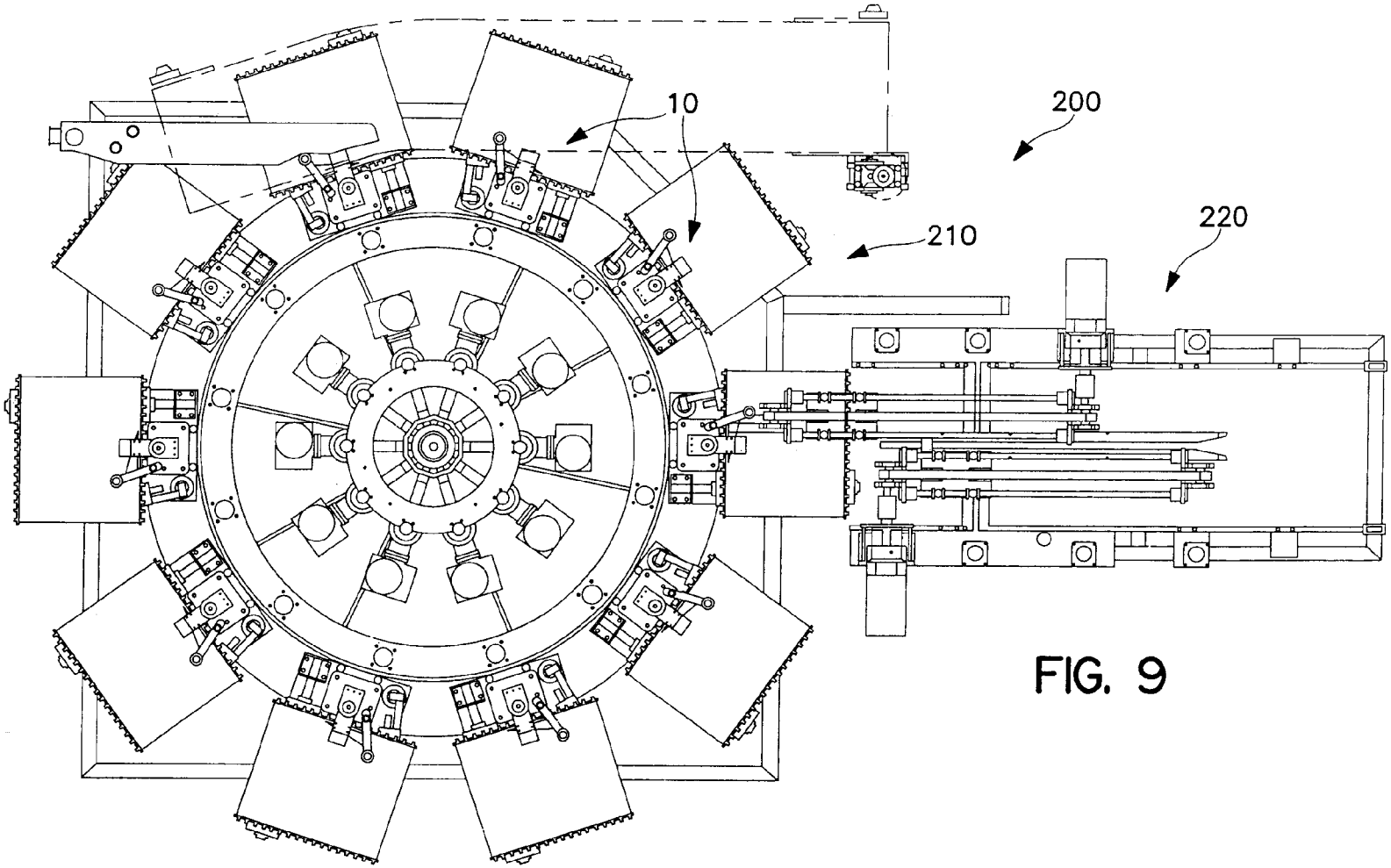
FIG. 9 of the drawings is a fragmentary top view of a filler device in accordance with the present invention.

Referring now to FIGS. 8 and 9, filler device sub-assembly 10 is primarily intended for use in association with filler device 200, which is capable of filling associated containers and/or bags with any one of a number of materials (i.e. product) in solid, liquid, and/or gaseous states.

Housing 11 is shown in FIGS. 1A–4 collectively as comprising base 22, upper plate 24, and riser posts 26, 28, 30, and 32. As will be understood, housing 11 provides a structure for the attachment and operation of the remainder of the filler device sub-assembly components. For example, base 22 includes opening 34 and upper plate 24 includes opening 36 for receiving and retaining cap manipulating means 14 and rim retaining means 12. Similarly, and as will be explained in greater detail herein, riser posts 30 and 32 provide a shaft upon which substantial sealing means 16 is linearly slidable. Housing 11 generally comprises a stainless steel material which is resistant to corrosion. Of course, other materials, such as aluminum and nonmetals are likewise contemplated for use. Indeed, the housing is not limited to any particular material, and various materials may be utilized depending on the particular application.

Rim retaining means 12 is shown in FIGS. 1B and 3–5 collectively as comprising first gripper arm 40, second gripper arm 42, pivot axle 41, means 43 for biasing the first gripper arm and the second gripper arm toward each other, and means 45 for guiding the rim into a desired gripped orientation. As is shown in FIG. 1B, first gripper arm 40 includes first end 44, second end 46 and pivot opening 48. Similarly, second gripper arm 42 includes first end 50, second end 52 and pivot opening 54. The two gripper arms combine to define rim retaining region 49, which accommodates and retains the rim of a particular container. The gripper arms are pivotally associated with pivot axle 41 which is fixed to opening 36 of upper plate 24 of housing 11. The pivot openings of the gripper arms are positioned about pivot axle 41 so that the gripper arms can pivot thereabout. In a grasping position, the first ends 44, 50 are in abutment and in contact with a stop, such as stop 150 (FIGS. 3 and 4) and the second ends are substantially in abutment. In the extended position, the first ends are away from the stop, and the second ends are separated so as to be ready to receive a rim.

Figure 3:
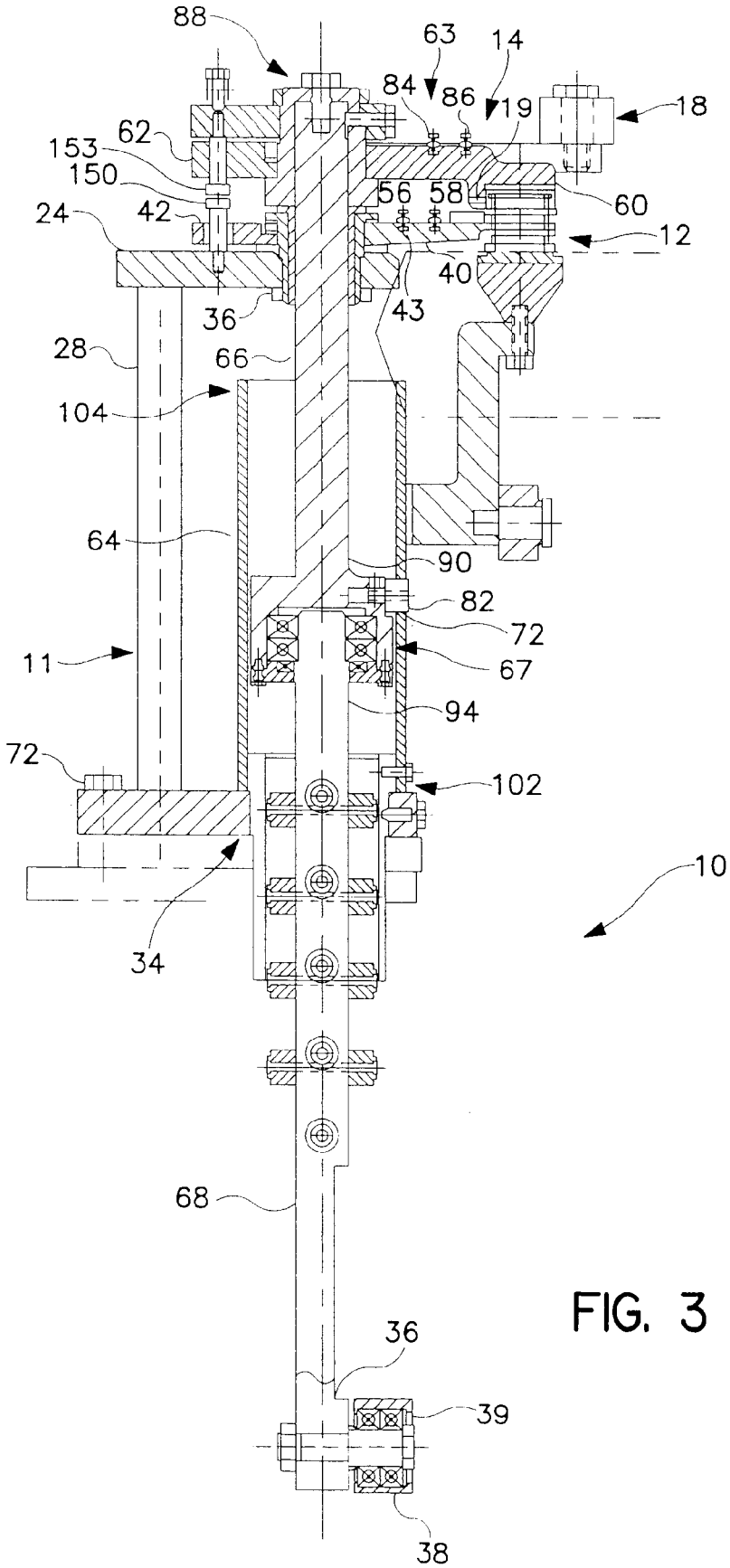
FIG. 3 of the drawings is a fragmentary side elevational view of a filler device sub-assembly in accordance with the present invention taken along line A—A of FIG. 1B.
Figure 4:
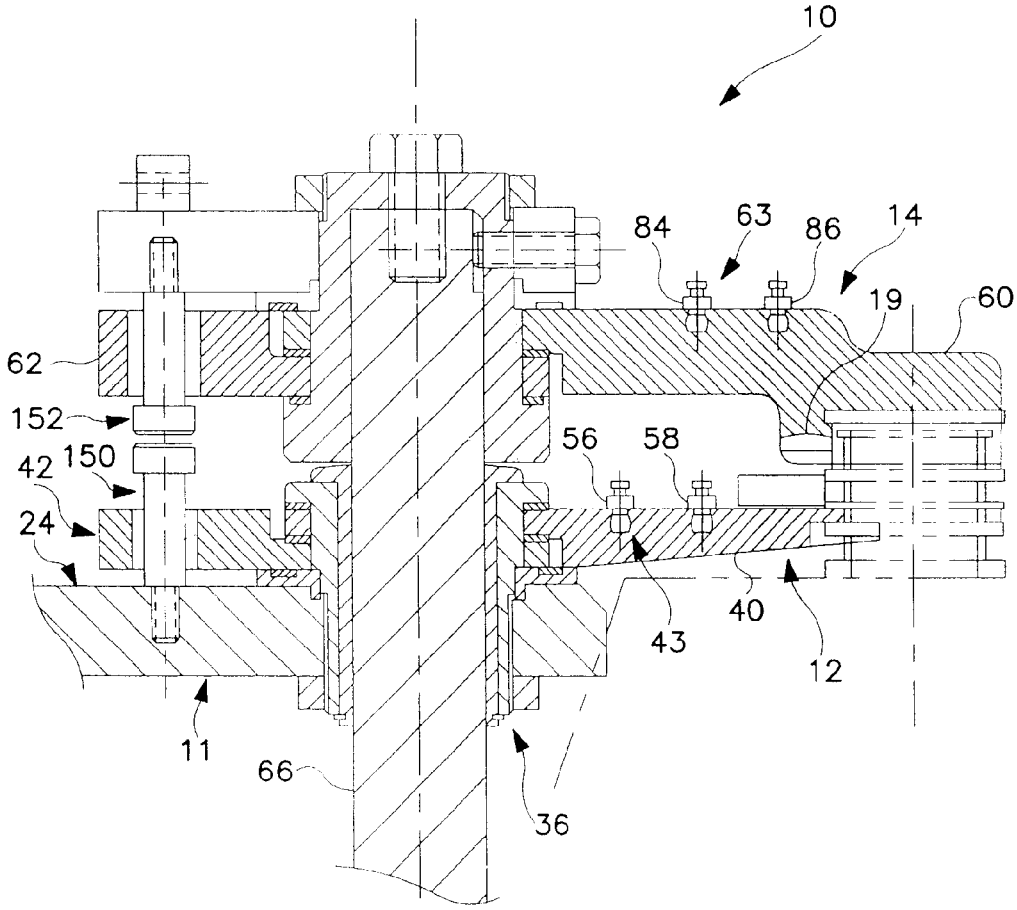
FIG. 4 of the drawings is a fragmentary side elevational view of a filler device sub-assembly in accordance with the present invention taken along line A—A of FIG. 1B showing, among other things, an upper end thereof.

Gripper arm biasing means 43 is shown in FIGS. 3 and 4 as comprising extension springs 56, 58 which are releasably attached to each of the gripper arms. In a steady state condition, the springs are extended, and, in turn, biased such that the second ends of the gripper arms are forced toward and into contact with each other. An external force is required to overcome springs 56, 58, to, in turn, separate the ends of the gripper arms 40, 42 from each other. In other embodiments, the retaining means may comprise compression springs which operate individually on each of the gripper arms. Of course other retaining means, such as gripper arms which utilize a hydraulic force or a pneumatic force to retain a rim are likewise contemplated for use.

Figure 5:
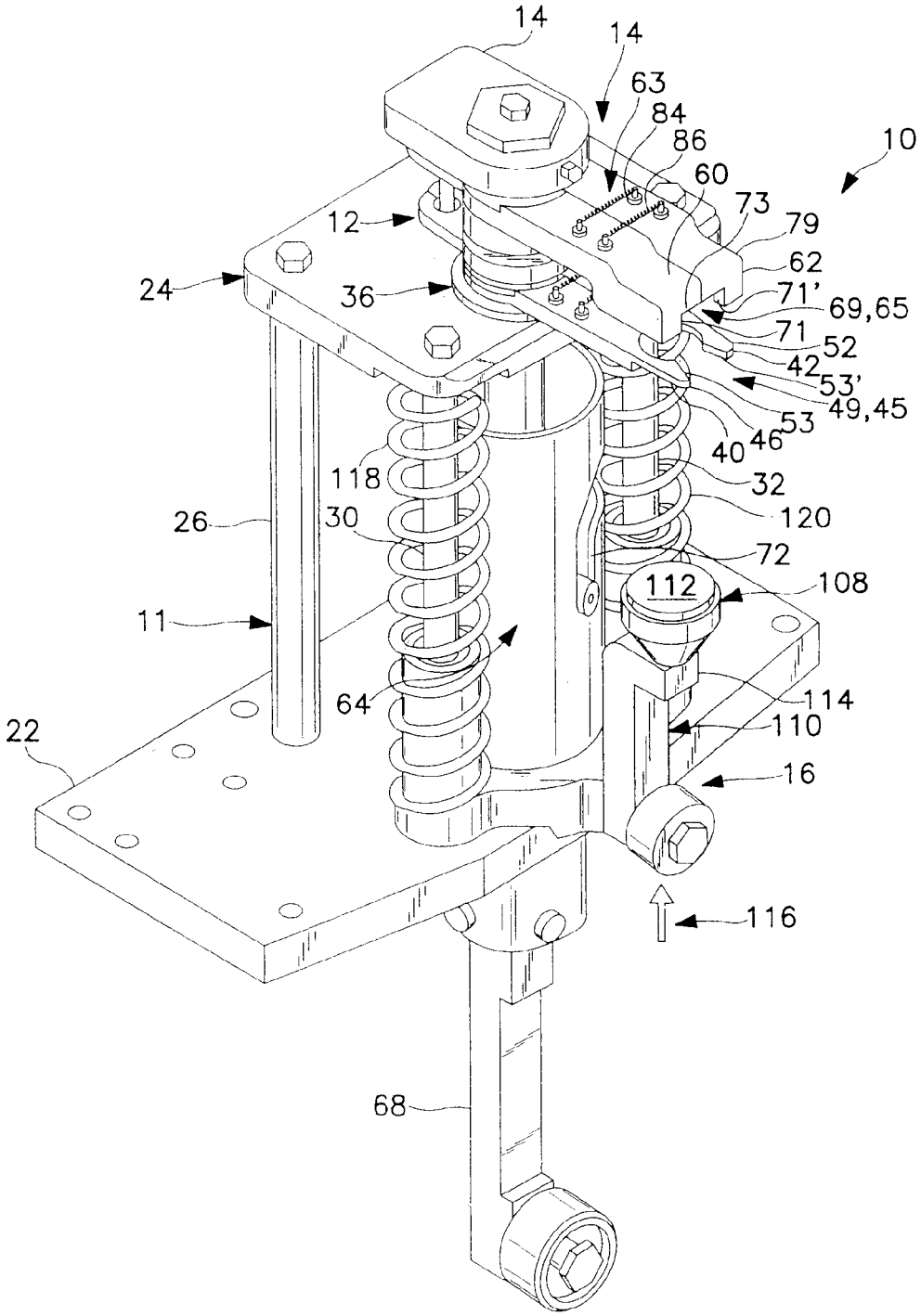
FIG. 5 of the drawings is a perspective view of a filler device sub-assembly in accordance with the present invention.

Referring now to FIGS. 1B and 5, rim guiding means 45 comprises rim extending surfaces 53, 53' which are associated with second ends 46, 52 of the respective first and second gripper arms. The rim extending surfaces are positioned such that upon outside contact, by, for example, a rim of a container, the gripper arms are pivoted away from each other. In addition, the rim extending surfaces are angled toward the rim retaining region such that upon outside contact, by a rim of a container, the rim extending surfaces (that are in contact with the rim) guide the rim toward and into rim retaining region 49. Preferably, the rim extending surfaces are angled toward the rim retaining region at an angle of about 15 to about 75 degrees. To achieve cooperative operation, the two cap extending surfaces are angled at substantially identical angles.

Cap manipulating means 14 is shown in FIGS. 1A, 3, and 5 collectively, as comprising first cap gripper arm 60, second cap gripper arm 62, means 63 for biasing the cap gripper arms toward each other, means 65 for guiding the cap into a gripped orientation, cam 64, rotation post 66 and lifter shaft 68. It will be understood that cap manipulating means 14 removes the cap from the container and directs the cap away from the container so that it may be filled. Subsequently, the cap manipulating means returns the cap to the container so that the container can be resealed.

Specifically, as is shown together in FIG. 1A, first cap gripper arm 60 includes first end 70, second end 73 and pivot opening 74. Similarly, second cap gripper arm 62 includes first end 77, second end 79 and pivot opening 80. As with the gripper arms 40, 42 of rim retaining means 12, cap gripper arms 60, 62 likewise define cap gripping region 69 (FIGS. 1A, 5) which is configured to accept and retain caps of a particular configuration.

The cap gripper arms 60, 62 are arranged so that the pivot openings 74, 80 are positioned to pivot about the axis of rotation post 66, from a grasping position to a released position. In a grasping position, the first ends are in abutment and in contact with a stop, such as stop 151, and the second ends are substantially in abutment. In the extended position, the first ends are away from the stop and the second ends are separated so as to be ready to receive a cap. Specifically, as is shown in FIGS. 1A, 4 and 5, similar to the gripper arms 40, 42, biasing means 63 forces cap gripper arms 60, 62 into a retaining position. Specifically, biasing means 63 includes extension springs 84, 86 which are releasably attached to each of the cap gripper arms to bias them toward each other. External force is required to overcome the springs so as to separate the ends of the cap gripper arms away from each other.

Cap guiding means 65 is shown in FIGS. 1A and 5 as comprising cap extending surfaces 71, 71' associated with the respective second ends of the cap gripper arms. As with the rim retaining means, the cap extending surfaces are configured so that contact by, for example, a cap of a container, directs the cap gripper arm (in contact with the cap of a container) in an outward direction and simultaneously guides the cap toward cap gripping region 69. To achieve this guiding of the cap, the cap extending surfaces are angled at an angle of about 15 to about 75 degrees. To achieve substantially cooperative operation, the two cap extending surfaces are angled at substantially identical angles and at angles substantially identical to the rim extending surfaces 53, 53'.

Rotation post 66 is shown in FIG. 3 as comprising first end 88, second end 90 and follower 82. Gripper arms 60, 62 are attached to first end 88 of rotation post 66, and follower 82 is attached to second end 90 of rotation post 66. Lifter shaft 68 includes first end 94, second end 96 and lifter surface 98. First end 94 of lifter shaft 68 is rotatably coupled to rotation post 66 by way of coupling 67. Lifter surface 98 includes roller member 99 which is coupled to second end 96 of lifter shaft 68.

Cam 64 is shown in FIG. 3 as comprising proximal end 102, distal end 104 and cam surface 72 (see also, FIG. 5). Proximal end 102 of cam 64 is attached to base 22 of housing 11. Cam 64 comprises a substantially cylindrical member. Rotation post 66, lifter shaft 68 and cam 64 are positioned such that they have a corresponding longitudinal axis. Cam surface 72 includes a configuration which facilitates the receipt and travel of follower 82 thereon from a lowest position to a highest position. In a lowest position, cap gripper arms 60, 62 are proximate upper plate 24 of housing 11. In a highest position, cap gripper arms 60, 62 are directed away from the upper plate.

As will be explained, cam surface 72 is configured so that each upward travel of lifter shaft 68 will yield a 90 degree rotation (or a rotation sufficient to allow free access to the rim by the fill valve of filler device 200) of rotation post 66, and each downward travel will return the rotation post 90 degrees (or other predetermined angle) to the original orientation. Of course other configurations are likewise contemplated which achieve different degrees of rotation.

Figure 2:
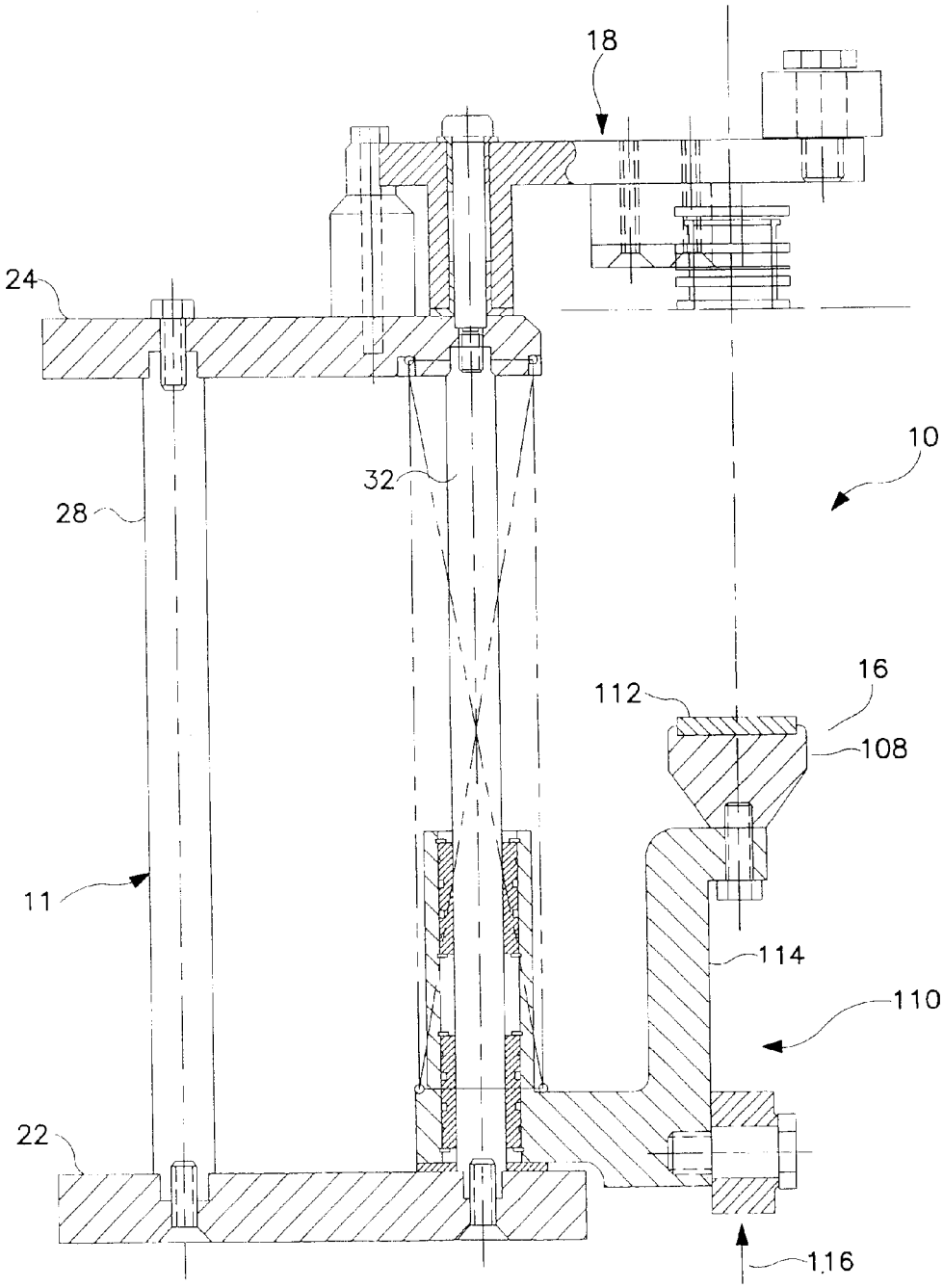
FIG. 2 of the drawings is a fragmentary side elevational view of a filler device sub-assembly in accordance with the present invention taken partially along line A—A and partially along line B—B of FIG. 1B.

As is shown in FIGS. 2 and 5 collectively, substantial sealing means 16 includes pad housing 108 and linear movement means 110. It will be understood that the substantially sealing means substantially seals the volume within the interior of the container from the outside of the rim of the container prior to and after filling to preclude contamination of the container as the cap is removed and replaced. Pad housing 108 includes fill pad 112 and slidable housing 114. Slidable housing 114 is slidably positioned on risers 30, 32 of housing 11. Linear bearings or the like may be utilized to facilitate the controlled low-friction movement of the slidable housing about risers 30, 32.

Linear movement means 110, is shown in FIGS. 2 and 5 as comprising, force means 116 for upwardly directing pad housing 108 and means for downwardly directing pad housing 108 which direct slidable housing 114 between from a first position proximate base 22 of housing 11 and a second position proximate upper plate 24 of housing 11. Upward moving means 116 may comprise a cam actuated by the rotative movement of the sub-assembly relative to the remainder of filler device 200 (FIG. 8), a pneumatic device, hydraulic device or electric device which is capable of overcoming return springs 118, 120 (FIG. 5) and to direct slidable housing 114 toward upper plate 24 of housing 11. Return springs 118, 120 (FIG. 5) return the slidable housing toward and preferably into contact with base 22 of housing 11. Of course, other assemblies which return pad housing 108 from upper plate 24 to base 22, including fully pneumatic, hydraulic or electric systems are contemplated for use.

Rim ejecting means 18 is shown in FIGS. 1A and 1B as comprising lever member 132, rotation pivot 134 and means 136 for rotating the lever member about the rotation pivot. Lever member 132 includes bar 140 and arm 142. Lever member 132 is configured so that, upon rotation about the rotation pivot, arm 142 is directed across second ends 46, 52 of the gripper arms of rim retaining means 12, to, in turn, dislodge and release a container retained by gripper arms 40, 42— as well as an associated cap. Rotating means 136 comprises a cam (not shown) which actuates, to, in turn, rotate the lever member about the rotation pivot. Various means for rotating the lever member are contemplated for use, including, but not limited to, pneumatic, hydraulic, electrical, or mechanical power.

Sensing means 19 is shown in FIGS. 3 and 4 as comprising at least one sensor positioned upon at least one of the rim retaining means and the cap gripping means. In one embodiment, the at least one sensor comprises a proximity type sensor associated with the cap gripping means and/or the rim retaining means. As such, the sensor facilitates the determination as to the presence or absence of a cap or a rim. Such a system can be alerted to a fault condition, and, in turn, the filling operation can be stopped in the event that a container rim or a cap is not present. Of course, other sensors, such as micro-switches, and/or optical sensors are contemplated for use in accordance with the present invention. While various configurations are contemplated, such sensors may be positioned on one or both of the rim gripping arms and/or the cap gripping arms.

In operation, and as is shown in FIGS. 8 and 9, filler device sub-assembly 10 is associated with rotatable filler device 200. Rotatable filler device 200 includes such assemblies 10 for each of the ten separate fill stations on rotating carousel 210.

To prepare the assembly for receipt of a container, pad housing 108 of substantial sealing means 16 is placed in a first position wherein slidable housing 114 is positioned away from upper plate 24 and preferably proximate base 22 of housing 11. Similarly, follower 82 is positioned relative to cam surface 72 so as to be in its lowest position. In such a position, cap gripper arms 60, 62 are proximate upper plate 24 and substantially aligned with the rim gripper arms.

Once properly configured, a container is supplied via container feed 220 (FIGS. 8 and 9). As the container contacts first and second gripper arms 40, 42 of rim retaining means 12, and first and second cap gripper arms 60,62 of cap manipulating means 14, the container rim contacts rim extending surfaces 53, 53' and the cap contacts cap extending surfaces 71, 71'. As the container (rim and cap) continue to move, the movement overcomes respective biasing means 43 and 63 and spreads the respective second ends of the gripper arms apart as the rim extending surfaces 53, 53' and the cap extending surfaces 71, 71' center the rim and cap, and, in turn, direct same into the respective retaining regions 49, 69. Once the cap and rim are received by the respective receiving regions 49, 69 defined by the second ends of the gripper arms, the biasing means direct the gripper arms toward each other so as to grasp and retain the rim and cap in a desired engaged position.

After the rim is retained by first and second rim gripper arms 40,42, and after the cap is retained by first and second cap gripper arms 60,62, substantially sealing means 16 maybe activated (Of course, in certain embodiments, the substantial sealing means may be modified and/or omitted from the process entirely). In turn, linear moving means 110 is powered to move pad housing 108. Specifically, upward moving means 116 of linear moving means 110 overcomes springs 118, 120, and moves slidable housing 114 associated with pad housing 108 toward upper plate 24 of housing 11. As the slidable housing 114 approaches upper plate 24, fill pad 112 engages the lower surface of the container, which, in turn, engages a lower surface of the rim of the container. However, in certain instances it may be positioned such that the product within the container is displaced by the pad such that the product engages the lower surface of the rim of the container. As the slidable housing is forced upward, the lower surface of the container (or product within the container) becomes engaged with the lower surface of the rim and the volume defined by the container is substantially sealed and/or substantially isolated.

Once a substantial seal is created with the rim, lifter shaft 68 of cap manipulating means 14 is activated by a vertical movement means, which directs the lifter shaft in an upward direction. Upward movement of the lifter shaft directs cap gripper arms 60, 62 which include the cap within cap gripping region 69 in an upward direction, thereby removing the cap from the rim. Inasmuch as the movement of follower 82 mounted proximate second end 90 of rotation post 66 is controlled by cam surface 72, as the rotation post moves in an upward direction by the lifter shaft, cam surface 72 imparts rotation to rotation post 66, thereby providing a rotative movement means. As was explained above, the upward stroke of the lifter shaft imparts a 90 degree (or other angular) rotation of rotation post 66, and, in turn, the attached cap, away from the rim of the container. Of course, it is contemplated that the cam surface can be configured in various configurations to import varying degrees of rotation.

As or after the rotation post, gripper arms, and cap rotate away from the rim of the container, the fill valve is freely moved into position proximate the rim of the container. Once the fill valve is positioned and once it engages the rim, slidable housing 114 is moved away from upper plate 24, toward base 22 of housing 11. At such time, the lower surface of the container (or the product) disengages from the rim thereby placing the volume defined by the container in fluid communication with fill valve. Subsequently, the fill valve is actuated, and the container is filled.

After the container is filled with product as desired, slidable housing 114 may be forced upward by upward moving means 116 until it again substantially seals the lower surface of the container relative to the lower rim of the container or product, to substantially isolate the fill valve from the volume defined by the container. Next, the fill valve is disengaged, and the cap manipulating means cycle is completed by a final downward stroke of the lifter shaft, which causes the cam surface to move follower 82 and rotate rotation post 66, and cap gripper arms 60, 62 90 in the opposite direction so that the cap again aligns with the rim and re-engages the rim of the container upon completion of the downward stroke. Once the cap reseals the container, upward moving means 116 is disengaged, and springs 118, 120 return slidable housing 114 toward base 22 of housing 11.

Next, the container is removed from the fill assembly by way of rim ejecting means 18. Specifically, rotating means 136 directs the rotation of lever member 132 about rotation pivot 134. As lever member 132 rotates, arm 142 pushes against the rim of the container. In turn, the force of the arm against the container overcomes biasing means 43 of rim retaining means 12 and biasing means 63 of cap manipulating means 14 thereby separating first and second gripper arms 40, 42, and first and second cap gripper arms 60, 62. Once these are separated, the continued rotation of the lever member expels the rim and the cap from the gripper arms. Once disengaged, the container can be removed from the rotating fill device. The lever member is returned to its original position, and the assembly is again ready to accept another container. The cycle is now ready to be repeated.

In a second embodiment of the invention, a filler device sub-assembly is provided which facilitates the filling of a container and the exchange of the cap of the container during filling. As such, a first cap (present on the container prior to filling) can be removed and, the container can be capped with a second cap upon completion of the filling process.

It will be understood that the cap manipulating means, housing rim retaining means, substantial sealing means, ejecting means and sensing means are contemplated to be substantially identical, or at least analogous in structure and/or function, to those identified with respect to the first embodiment.

In this second embodiment, the cap gripper arms (not shown) are mounted on rotating plate 110. The particular operation of the gripping arms is substantially the same as in the first embodiment with the exception that gripper arms may be centered upon a pivot axis which does not correspond to the pivot axis of the rotation post.

In the second embodiment, the cap manipulating means 14 includes cam 164 in place of cam 64 and means 169 for lock-step rotation of rotation post 66 relative to lifter shaft 68.

Figure 6:
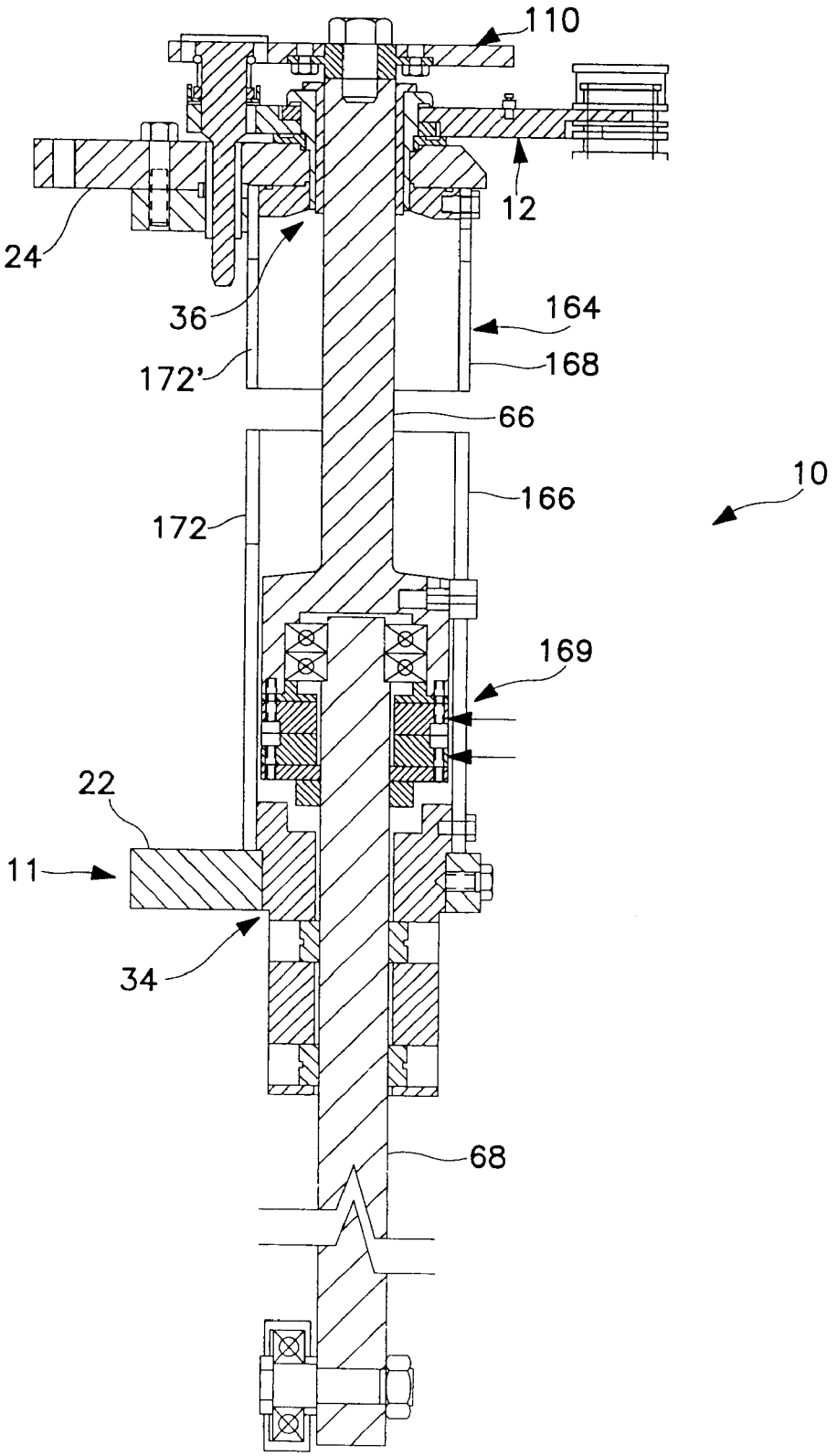
FIG. 6 of the drawings is a fragmentary side elevational view of an embodiment of a cap manipulation means in accordance with the present invention.
Figure 7:
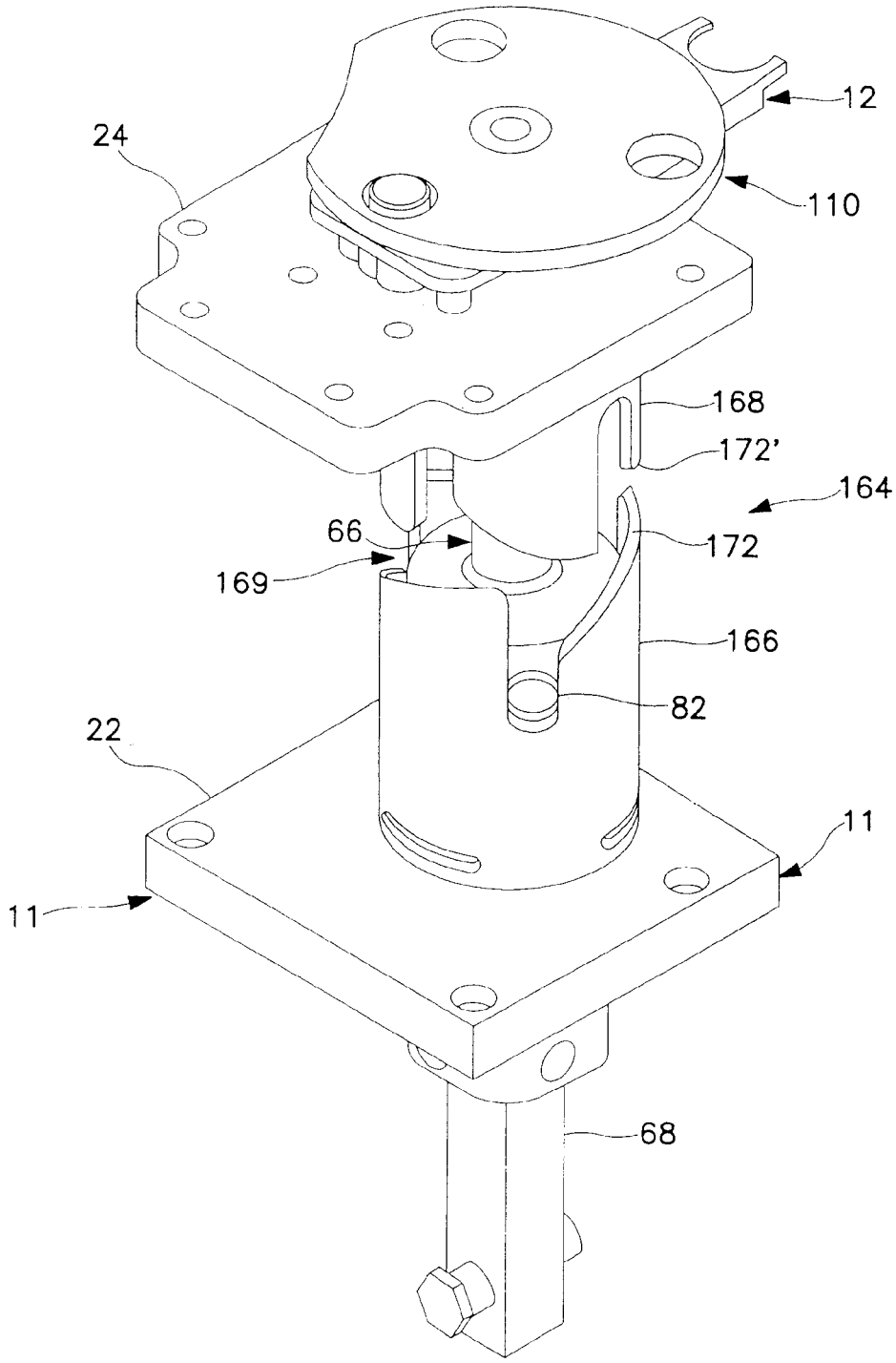
FIG. 7 of the drawings is a perspective view of an embodiment of a cap manipulation means in accordance with the present invention.

In particular, as shown in FIGS. 6 and 7, cam 164 comprises lower cam portion 166 and upper cam portion 168. The lower cam portion and upper cam portion are spaced apart a predetermined distance sufficient to permit movement of follower 82 therebetween. Lower cam portion 166 includes cam surface 172 and upper cam portion 168 includes cam surface 172'. As will be explained, the positioning and spacing of the lower and upper cam portions, follower 82 is capable of traveling the full 360 degrees of cam 164.

Lock step rotation means 169, as shown in FIG. 6, comprises a lower series of magnets 180 associated with lifter shaft 68 and an upper series of magnets 182 associate with rotation post 66. The lower series of magnets are positioned circumferentially around the lifter shaft in order of alternating polarity. Similarly, the upper series of magnets are positioned circumferentially around the rotation post in order of alternating polarity.

The upper and lower series of magnets are positioned in close proximity such that the magnetic fields overlap and interact. In particular, if one magnet of the upper series of magnets overlays a magnet of the lower series of magnets of the same polarity, the magnets will repel causing rotation post 66 to rotate into a position wherein interacting magnets of the upper and lower series of magnets are opposite in polarity. In such an orientation, the two series of magnets serve to lock the rotation post and the lifter shaft together until the magnetic force is overcome.

In operation of this embodiment, after the cap and rim are retained and the substantial seal is created between the rim and the lower surface of the container (as described with respect to the first embodiment), the cap manipulating means is activated and directs the lifter shaft in an upward direction. The upward movement first directs the gripper arms away from the rim, thereby removing the cap from the rim.

The continued upward movement directs follower 82 into the cam surfaces 172, 172'. Specifically, the follower 82 contacts upper cam surface 172' which overcomes the magnetic force of the lock step means and impacts rotation of the rotation post relative to the lifter shaft. As the cam begins to return downward, the lock step means directs further rotation of the rotation post relative to the lifter shaft until an orientation which pairs magnets of opposing polarity is achieved.

At such time, the lifter shaft has returned to its lowest position and the cycle is repeated. In the embodiment shown in FIGS. 6 and 7 collectively, the upper and lower cam portions and the magnets of the upper and lower series of magnets 180 and 182, respectively, are configured such that each complete upward and downward movement of the lifter shaft corresponding to 120 degrees of rotation of the rotation post. In particular, the upward stroke overcomes magnetic force and rotates the lifter shaft 60 degrees. Similarly, the downward stoke overcomes magnetic force and rotates the lifter shaft another 60 degrees in the same direction. The magnets serve to urge the lifter shaft into the desired orientation during rotation and to retain the lifter shaft in the desired orientation at the conclusion of each downward stroke.

In such an embodiment, an additional apparatus (not shown) may be incorporated to remove the cap from the respective gripper arms and to replace a second cap into the gripper arms, as it is directed about a complete revolution. In turn, a conventional cap from the container can be removed by the cap manipulating means during one cycle, ejected into a cap collecting container and replaced by a stylized cap in a second cycle, and finally replaced on the container during the third cycle.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A filler device sub-assembly, comprising:

a first cap gripping arm and a second cap gripping arm, wherein each of the first and second cap gripping arms include a second end, and wherein the second ends of the first and second cap gripping arms cooperatively define a cap retaining region;

a pivot opening associated with each of the first and second cap gripping arms, wherein the first and second cap gripping arms are pivotable about the pivot opening; and means for guiding a cap into the cap retaining region, wherein the cap guiding means facilitates outward pivoting of at least one of the first and second cap gripping arms by a cap which results in directing a cap into the retaining region toward retention thereof; and a first rim gripping arm and a second rim gripping arm, wherein each of the first and second rim gripping arms include a second end, and wherein the second ends of the first and second rim gripping arms cooperatively define a rim retaining region, and further wherein the first and second rim gripping arms are pivotable about the pivot opening and;

means for guiding a rim of a container into the rim retaining region, wherein the rim guiding means facilitates outward pivoting of at least one of the first and second rim gripping arms by a rim which results in directing a rim of a container into the rim retaining region toward retention thereof, wherein the pivot opening of the first and second cap gripping arms and the pivot opening of the rim gripping arms are substantially coaxial and wherein the cap retaining region and the rim retaining region are substantially coaxial.

2. The filler device sub-assembly according to claim 1, wherein the cap guiding means further includes an extending surface associated with at least one of the first and second cap gripping arms, wherein the extending surface facilitates the outward pivoting of the associated cap gripping arm upon contact by a cap.

3. The filler device sub-assembly according to claim 2, wherein each of the first and second cap gripping arms includes an extending surface.

4. The filler device sub-assembly according to claim 1, further comprising means for biasing each of the first and second cap gripping arms toward each other.

5. The filler device sub-assembly according to claim 4, wherein the biasing means comprises at least one spring attached to each of the first and second cap gripping arms.

6. The filler device sub-assembly according to claim 1, further including means for sensing at least one of the presence and/or absence of a cap within the holding region.

7. The filler device sub-assembly according to claim 6, wherein the sensing means comprises a proximity sensor.

8. The filler device sub-assembly according to claim 1, wherein each second end of the first and second cap gripping arms is configured so that the defined retaining region substantially matches the configuration of a cap.

9. A filler device sub-assembly, having a means for manipulating a cap, comprising:

a rotation post having a follower attached thereto;

a first and second cap gripper arm capable of retaining a cap in a gripped orientation, the first and second cap gripper arms being pivotally associated with the rotation post; and a cam associated with the follower;

wherein the cam actuates the follower to, in turn, impart rotation of the rotation post and associated cap gripper a predetermined arcuate distance upon movement of the rotation post in either of a substantially upward and substantially downward movement.

10. A filler device sub assembly, having a means for manipulating a cap, comprising:

a rotation post having a follower attached thereto;

a first and second cap gripper arm capable of retaining a cap in a gripped orientation, the first and second cap gripper arms being pivotally associated with the rotation post; and a cam associated with the follower, the cam including an upper cam portion and a lower cam portion;

wherein the cam actuates the follower to, in turn, impart rotation of the rotation post and associated cap gripper arms a predetermined arcuate distance upon movement of the rotation post in one of substantially upward and substantially downward movement and a further predetermined arcuate distance in the same direction upon movement of the rotation post in the other of a substantially upward and substantially downward movement, such that continued actuation directs the rotation post through a full rotation.

* * * * *